United States Patent [19]

Schmidt

[11] 3,998,473

[45] Dec. 21, 1976

[54] SAFETY SKI-BINDING

[75] Inventor: Johann Schmidt, Neu-Germering, Germany

[73] Assignee: Hannes Marker, Garmish, Germany

[22] Filed: Apr. 16, 1975

[21] Appl. No.: 568,528

[30] Foreign Application Priority Data

Apr. 24, 1974 Germany ..... 2419326

[52] U.S. Cl. ..... 280/618; 280/613; 280/637

[51] Int. Cl.[2] ..... A63C 9/086

[58] Field of Search ..... 280/11.35 K, 11.35 C, 280/11.35 R, 11.35 N, 637, 618, 623, 613

[56] References Cited

UNITED STATES PATENTS

| | | | |
|---|---|---|---|
| 2,259,701 | 10/1941 | Legros | 280/11.35 N |
| 3,822,070 | 7/1974 | Salomon | 280/11.35 N |
| 3,893,682 | 7/1975 | Weinstein et al. | 280/11.35 N |

FOREIGN PATENTS OR APPLICATIONS

| | | | |
|---|---|---|---|
| 2,156,936 | 5/1972 | Germany | 280/11.35 N |

*Primary Examiner*—M. H. Wood, Jr.
*Assistant Examiner*—David M. Mitchell
*Attorney, Agent, or Firm*—Fleit & Jacobson

[57] ABSTRACT

In a safety ski-binding connecting a ski boot to the sole plate of a ski or directly on a ski by means of two cable controls which can each be pulled out to a limited extent against the force of a spring, retaining means are provided in association with each cable control to prevent automatic resetting of the cable control after the latter has been extended during a fall. The retaining means are only deliberately releasable and may comprise a ratchet wheel connected to the cable drum to rotate therewith and a pawl associated with the ratchet for normally preventing the drum from turning back.

8 Claims, 3 Drawing Figures

SAFETY SKI-BINDING

The present invention relates to safety ski-bindings which connect the ski boot to a ski, either directly or indirectly by way of a sole plate, by means of at least one cable control engaging near each of the front and back of the sole of the boot, wherein the cable controls can be pulled out to a limited extent against the force of a spring.

Such a safety ski-binding, wherein the cable controls engage fittings fixed to the sole of the boot, is shown for example in German Pat. No. 2,156,936. An even older safety ski-binding of this kind but likewise disclosed only on paper and comprising a sole plate for the ski boot is disclosed for example in Austrian Pat. No. 211,203.

These safety ski-bindings avoid the unintentional complete detachment of the ski boot from the ski. After relative motion between the ski boot and the ski as a result of an excessive load that is not only of impact form, the force of the spring automatically brings the boot and ski together again. The characteristic of the springs necessitates an increase in the spring force with increasing motion of the ski boot relatively to the ski.

In the aforementioned prior art bindings, after lateral movement of the boot, possibly in conjunction with a sole plate, relatively to the ski and also after lifting off of same from the ski, the boot is automatically returned to the ski or the ski is automatically pulled back towards the boot under the influence of the spring force when the force that caused the movement has slackened off or disappeared. This automatic resetting presents a decided danger in so far that a fallen skier who has injured his leg and possibly broken it may injure himself even more severely. More particularly, this can occur when the binding returns to its operative condition before the skier comes to rest. During the latter part of the fall, and even when the skier has finally ceased to move and the ski is disposed obliquely relatively to the boot, the leg that is already injured will have a load applied to it through the lever arm constituted by the boot or ski and generally become injured even further or more severely.

It is therefore an object of the invention to avoid this additional risk of injury. According to the invention, a safety ski-binding is provided which connects a ski boot to a ski, either directly or indirectly by way of a sole plate, by means of at least one cable control engaging near each of the front and back of the sole of the boot, wherein the cable controls can be pulled out to a limited extent against the force of a spring, retaining means being provided which are effective, during a fall after extension of the cable control, to prevent automatic resetting of the cable control and which are only deliberately releasable.

If the binding is equipped with a spring influenced cable drum, then a ratchet wheel may be connected thereto to rotate therewith and a pawl can be associated with the ratchet for normally preventing the drum from turning back.

An example of the invention will now be described with reference to the accompanying drawings, wherein.

Figures 1, 2, 3:
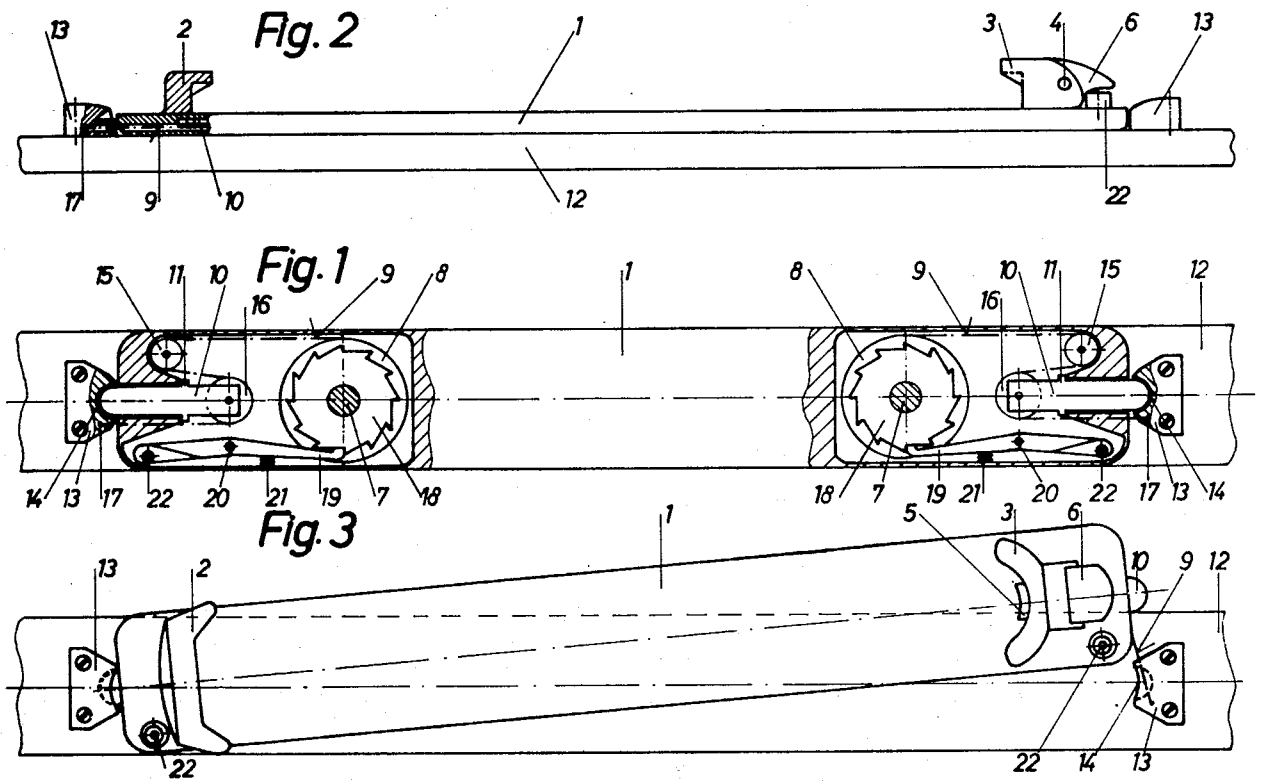
FIG. 1 is a part-sectional plan view on a safety ski-binding.
FIG. 2 is a side elevation of the binding of FIG. 1.
FIG. 3 is a plan view of the same ski-binding with the sole plate swung out laterally.

The illustrated ski-binding is a so-called plate binding. The sole plate 1 carries at one end a sole holder 2 for receiving and securing the front end of the sole of the boot. At its other end, the sole plate carries a sole holder 3 which is pivotable relatively to the sole plate about a horizontal transverse shaft 4. Fixedly secured to the sole holder 3 there is a pedal 5 (see FIG. 3) so that, after introducing the front end of the sole of the boot in the sole holder 2, the holder 3 will automatically tilt to its locked position during the stepping-in procedure as the rear of the boot is depressed. The sole holder 3 can only be deliberately released from this locked position, for example by actuating an opening handle 6.

As will be evident from FIG. 1, two cable controls are provided in the sole plate 1. The two cable controls are mirror images of one another and consequently only one of them will be described and the same reference numerals are used for both. A cable drum 8 is mounted on a vertical shaft 7 in the sole plate. This cable drum is under the influence of a spiral spring such as that known from German Pat. No. 2,156,936. Since the spring is known per se, it will not be necessary to describe it in detail and it has been omitted from the drawings for clarity. It suffices to say that the spiral spring biasses the cable drum 8 in the sense of winding the cable 9 thereon.

Each cable control comprises a slide latch 10 which is displaceable lengthwise of the sole plate 1 and the operative end of which projects from the associated end of the sole plate. To limit the movement of the slide latch in the projected or outward direction, it is provided with abutments 11. A fitting 13 containing a catch groove 14 is screwed onto the ski 12 adjacent each end of the sole plate 1 for co-operating with the slide latches 10.

The cable 9 of each cable control extends from the cable drum 8 over pulleys 15, 16 to a fixed anchoring point 17 on the fitting 13. Whereas the pulley 15 is rotatably mounted in the sole plate 1, the pulley 16 is mounted on the inner end of the slide latch 10.

Connected to the cable drum 8 for rotation therewith there is a ratchet wheel 18 of means for retaining the drum after the cable 9 has been extended. These retaining means include a pawl 19 mounted in the sole plate 1 on a vertical shaft 20. The pawl is in the form of a bell crank lever and is subjected to the influence of a retaining spring 21 which normally holds the pawl in engagement with the ratchet wheel 18. The sole plate 1 also accommodates a push button 22 which, when actuated, is effective to swing the pawl 19 against the action of the retaining spring 21 to disengage it from the ratchet wheel 18.

FIGS. 1 and 2 show the safety ski-binding in its normal operating condition on the ski. By reason of the course followed by the cable over the pulley 16 on the slide latch 10, the latter is biassed into engagement with the catch groove 14 of the fitting 13 at practically twice the force exerted by the spiral spring on the cable. On the occurrence of a large torque and/or lifting-off force on the ski boot, the slide latch 10 is displaced relatively to the catch groove 14 and eventually disengaged therefrom. On further movement of the sole plate 1 relatively to the ski, the pulley 16 serves merely as a direction-changing roll for the cable and therefore movement of the plate during extension of the cable 9 is now only opposed by the lower resistance offered by the spiral spring.

The retaining means 18, 19 provided in accordance with the present invention prevent automatic resetting of the sole plate 1 on the ski 12 or, conversely, pulling up of the ski against the sole plate after the latching means have been released and when the force that gave rise to the movement of the sole plate has slackened off or disappeared. In this way the need is avoided for opening the or each latching means two or more times during any one fall.

If, after a fall, the skier has come to rest, he need only actuate the push button 22 to release the latching means, whereby the cable 9 is pulled in as it is wound on the drum 8 and the binding is reapplied to the ski.

I claim:

1. A safety ski-binding which connects a ski boot to a ski, and comprising at least one cable control releasably holding each of the front and back of the sole of the boot adjacent the ski, each cable control including a housing, a cable, a spring biasing the cable so as to be pulled into the housing, retaining means for resisting the return of the cable to said housing once the cable is pulled out of the housing, and reset means for deactivating said retaining means, wherein said cable can be pulled out to a limited extent against the force of said spring, and wherein said retaining means are effective, during a fall after extension of the cable control, to prevent automatic resetting of the cable control and which are only deliberately releasable.

2. A safety ski-binding according to claim 1 wherein said retaining means includes a spring influenced cable drum on which said cable is wound and which is biassed by said spring, a ratchet wheel connected to said cable drum to rotate therewith, and a pawl associated with said ratchet wheel for normally preventing the drum from turning back and enabling the cable to return to said housing.

3. In a releasable ski binding for coupling a ski boot on a ski having at least one flexible cable between two parts including a member carried by said boot and a member fixed to the ski, one of the ends of the cable being fixed in one of said two parts and at least a partial amount of said cable being wound on a rotatable member on said other of said two parts, said cable being normally wound when said boot is proximate said ski, the improvement which comprises at least one retaining means associated with at least one of said flexible cables so that upon extension of said cable, return of the cable to the original wound position is prevented.

4. The ski binding according to claim 3 wherein said member carried by said boot is a sole plate detachably connected thereto, said rotatable member is spring biased, and said retaining means includes ratchet and pawl means associated with said rotatable member for preventing the rotatable member from rotating back after extension of said cable.

5. The ski binding of claim 4 including means for disengaging the pawl from the ratchet so that the cable is rewound after extension.

6. A ski binding for coupling a ski boot on a ski comprising: a sole plate arranged for positioning in underlying contact with the ski boot and for detachable connection thereto; a first sole holder mounted on said sole plate for holding the front end of said boot; a second sole holder mounted on said sole plate for holding the rear end of said boot; at least one mounting means for securing said sole plate to cooperating holding means on the ski, said mounting means including slidable latch means for cooperating with said holding means, and abutment means on said latch means cooperating with said sole plate for limiting the extension of said latch means; a first pulley means rotatably mounted on said latch means; a cable-support rotatably mounted on said sole plate; said cable support including spring means for limiting rotation of said support, an elongated flexible cable supported partially on said cable support and connected with said holding means, said cable being normally wound around said support and in a retracted position when said latch means is proximate said holding means and extending over said first pulley, and means for retaining said cable in an extended position after extension, said retaining means including ratchet means associated with said cable support and pawl means mounted on said sole plate and associated with said ratchet means for normally preventing said cable support from rotating back after extension of the cable.

7. A ski binding according to claim 6 including means for disengaging said pawl means from said ratchet means so that the cable is rewound after extension.

8. The ski binding according to claim 6 including second pulley means mounted on said sole plate and said cable extending over said second pulley means.

* * * * *